US005664431A

United States Patent [19]

Martin, Sr.

[11] Patent Number: 5,664,431

[45] Date of Patent: Sep. 9, 1997

[54] DRAIN PAN

[76] Inventor: Lendell Martin, Sr., 7037 Brittmore, Houston, Tex. 77041

[21] Appl. No.: 635,602

[22] Filed: Apr. 22, 1996

[51] Int. Cl.[6] ..... F25D 21/14

[52] U.S. Cl. ..... 62/286; 62/288

[58] Field of Search ..... 62/272, 285, 286, 62/288, 291

[56] References Cited

U.S. PATENT DOCUMENTS

| | | | |
|---|---|---|---|
| 1,819,608 | 8/1931 | Lewis | 165/124 |
| 1,846,608 | 2/1932 | Phelps . | |
| 1,860,357 | 5/1932 | Gant . | |
| 1,863,554 | 6/1932 | Alberts . | |
| 2,584,442 | 2/1952 | Frie | 257/137 |
| 2,995,906 | 8/1961 | Brandimarte | 62/427 |
| 3,299,660 | 1/1967 | Sullivan | 62/285 |
| 3,372,870 | 3/1968 | Norris et al. | 236/13 |
| 3,405,758 | 10/1968 | Walker | 165/16 |
| 3,411,569 | 11/1968 | Hildreth | 165/63 |
| 3,464,487 | 9/1969 | Gold et al. | 165/16 |
| 3,540,526 | 11/1970 | Hoaglund et al. | 165/22 |
| 3,596,475 | 8/1971 | Berger | 62/285 |
| 3,716,097 | 2/1973 | Kelp et al. | 165/39 |
| 4,000,779 | 1/1977 | Irwin | 165/111 |
| 4,076,072 | 2/1978 | Bentz | 165/41 |
| 4,088,466 | 5/1978 | Humphrey et al. | 62/286 |
| 4,429,734 | 2/1984 | Vandervaart | 165/29 |
| 4,474,232 | 10/1984 | Wright et al. | 165/137 |
| 4,542,786 | 9/1985 | Anders | 165/144 |
| 4,671,076 | 6/1987 | Duren | 62/289 |
| 4,698,982 | 10/1987 | Laios et al. | 62/286 |
| 5,121,613 | 6/1992 | Cox et al. | 62/419 |
| 5,143,178 | 9/1992 | Latham, Jr. | 184/106 |
| 5,207,074 | 5/1993 | Cox et al. | 62/285 |
| 5,284,027 | 2/1994 | Martin, Sr. | 62/291 |
| 5,347,980 | 9/1994 | Shellenberger | 126/110 |

OTHER PUBLICATIONS

Ruud Form E22–301, Rev. 7, Ruud Air Conditioning Div., 1988.

A Coil Of Quality, ASM Series Low Profile Vertical Coils, All Style Coil Co., Inc. 1994.

A Coil of Quality, Evaporator Coils For All Styles of Air Conditioning Equipment, Allstyle Coil Co., Inc., 1994.

Payne Model 519E, Form No. PDS 519E 18.4P, Payne Air Conditioning, 1990.

Ruud Indoor Coils, Form No. C22–201, Rev. 12, Ruud Air Conditioning Div., 1989.

"How It Works—Air Conditioning," Popular Mechanics, Feb. 1993, p. 93.

*Primary Examiner*—William Doerrler

*Attorney, Agent, or Firm*—Guy McClung

[57] ABSTRACT

A drain pan system has been invented for receiving water condensed on and flowing from an air conditioning coil, including a pan with a pan member for receiving and holding water from the coil, and the pan member having a side lip for connecting to an adjacent pan, the adjacent pan adjacent the coil and disposed at an angle to the pan member. In one aspect the drain pan is used with the coil which is generally configured in a V-shape when viewed from an end thereof. In one aspect the system includes a lateral pan or pans sealingly connectible to the adjacent pan and to which the pan member is sealingly secured.

9 Claims, 4 Drawing Sheets

DRAIN PAN

BACKGROUND OF THE INVENTION

1. Field Of The Invention

This invention is related to drain pans for air conditioning systems and apparatuses, e.g. for heating or cooling air; in one aspect to such systems including a coil and in another aspect to a V-configured coil and drain pan for it.

2. Description Of Related Art

Coils for air conditioning systems are installed in housings, many of which are sized to meet common industry requirements. Also, in many housings the coil is oriented in a particular direction depending on the coil design and housing design. Coil orientation is also limited by available drain pan design. In certain housings, e.g. a V-configured coil is situated with the V pointing up; in other housings the V is on its side. Different drain pans are used for different housings. In various prior art air conditioning systems a blower propels air through a coil or sucks air through a coil. Through various openings in a housing or in a plenum box, air exits into conduits which carry it to various locations.

In certain situations in which a V-coil is already positioned in a housing with the V pointing up and a pan beneath coil, it is desired to turn the housing on its side to lay it down horizontally, either to the left or to the right. This requires installation of a side shield pan—which becomes the lower pan. In the prior art such pans have had their own drain nipple and one pan is usually only in one orientation—left or right so that a pan used, e.g. for a left orientation can not be used to turn the housing the other way; i.e., two pans are needed if it is not known or anticipated which way the housing is to be turned.

FIG. 1A shows a prior art drain pan. FIG. 1B shows a prior art pan system with two sub-pans. The lower sub-pan has its own drain nipple and cannot be switched to the other side (top side in the drawing) of the coil unless another drain nipple is added (which would need to be added to the far side as viewed in the drawing) before the pan is switched to the other side.

There has long been a need for a drain pan suitable for multiple coil orientations. There has long been a need for such an apparatus which is simple, easily made, easily installed, and easily accessed.

SUMMARY OF THE PRESENT INVENTION

The present invention discloses, in one embodiment, a drain pan system for an air conditioning system (cooling or heating) with a coil.

In one embodiment a drain pan system according to this invention includes a central pan, a lateral pan with a drain nipple, and a side pan attached to or formed integrally of the lateral pan. In one aspect a lateral pan is connected to the central pan and the side pan is secured to the lateral pan. The central pan, in one embodiment, has a bottom, a bottom opening, two sides, and two ends spaced apart and interconnected between the sides. A coil may be positioned on the pan so that air will flow through the bottom opening of the central pan and then through the coil.

In one embodiment the side pan has a bottom and three interconnected sides (or two ends and a side) and a depending lip or side for connecting the side pan to a lateral pan connected to the central pan. The lateral pan can be secured to the central pan with a friction fit and/or with an adhesive (e.g. epoxy) and/or with connectors such as screws.

In one embodiment in which a lateral pan is used, the lateral pan is sized to receive a portion of the central pan with a friction fit. In another aspect the lateral pan has a lip or ridge which positions the lateral pan with respect to the central pan and facilitates the securement of the lateral pan to the central pan. A stud or series of studs achieves the same purpose. In one aspect the lateral pan has a drain fitting opening and is shaped, sized and configured so that it can be used on either side of the central pan; thus one and the same side pan may be used on either side of the central pan without the need for a drain on the side pan.

When the coil is used in a vertical or upright disposition, water condensing on the coil flows down to two outward edges of the coil and down to portions of the bottom of the central pan. It is also within the scope of this invention to dispose the coil on its side generally horizontally. When a coil is used in the horizontal position, condensed water flows down from the coil to the side pan of the system. The side pan is disposed so water flows down it to a lateral pan from which it drains. The pan system according to this invention provides the ability to orient a coil in a housing either vertically or horizontally so that a single coil design can be used in either position with a single pan system, and horizontally either to the right or to the left using only one easily removable easily installed lateral pan and one side pan.

In one embodiment of the present invention, an air conditioning system is provided that has a system enclosure, a blower for moving air through the enclosure and through a coil; an air conditioning coil within the enclosure; and a drain pan system for receiving water condensed on and flowing from the coil, the drain pan having a central pan, one or two lateral pans as described herein, and a side pan so the coil (and housing if desired) can be oriented vertically, horizontally to one side, or horizontally to the other side, the central pan and the lateral pan(s) having a water drain outlet. In certain embodiments, open ends of the coil are closed off with closure plates. In another embodiment the side pan may have a drain outlet or nipple.

In certain embodiments the present invention discloses a drain pan system for receiving water condensed on and flowing from an air conditioning coil, the pan including a side pan for receiving water from the coil, the side pan having a pan member with three raised sides and an open end and configured so that water is flowable out from the open end, and the open end sealingly securable to an adjacent lateral pan so that water flowable from the open end flows to the adjacent lateral pan; in one aspect of such a drain pan system the side pan has a lip extending from the open end, the lip receivable in the adjacent lateral pan to facilitate positioning of the side pan with respect to the adjacent lateral pan and securement of the side pan to the adjacent lateral pan; such a drain pan with a lateral pan, the lateral pan adjacent to the side, and the side pan's open end sealingly connected to the adjacent lateral pan, the lateral pan having drain apparatus for draining water received from the side pan; such a drain pan system wherein the coil has a height, the side pan has a width, the lateral pan has a width, and the combined widths of the lateral pan and the pan member exceed the height of the coil sufficiently to catch moisture blowing from the coil; such a drain pan wherein the side pan has at least one support for supporting the side pan, the support sized so that in use the pan member is tilted so that water runs from the pan member to the adjacent lateral pan; such a drain pan system wherein the coil is on a central pan and the lateral pan has a bottom pan member surrounded by four interconnected sides, pairs of sides spaced apart from each other by the bottom pan member, and the lateral pan is securable to a side of the central pan so that the side is received within the lateral pan with a sealing friction fit; such a drain pan system with holding apparatus on the lateral pan for facilitating receipt within the lateral pan of a side of the central pan and correct positioning of the lateral pan on the central pan, and for holding the lateral pan on the central pan; such a drain pan system wherein the coil is on a central pan having four spaced-apart sides and the lateral pan is sized and configured for use on either of two spaced apart sides of the central pan so that the coil is tiltable ninety degrees to the left or to the right and the side pan is disposable beneath the coil whichever way the coil is tilted; such a drain pan system including the air conditioning coil; such a drain pan system including a housing in which the air conditioning coil is mounted, a blower for moving air through the housing, and at least two openings in the housing for circulating air therethrough; such a drain pan system for receiving water condensed on and flowing from an air conditioning coil, the pan having a side pan for receiving water from the coil, the side pan having a pan member with three raised sides and an open end and configured so that water is flowable out from the open end, and the open end sealingly securable to an adjacent lateral pan so that water flowable from the open end flows to the adjacent lateral pan, the side pan having a lip extending from the open end, the lip receivable in the adjacent lateral pan to facilitate positioning of the side pan with respect to the adjacent lateral pan and securement of the side pan to the adjacent lateral pan, the lateral pan, the lateral pan adjacent to the side pan, the side pan's open end sealingly connected to the adjacent lateral pan, the lateral pan having drain apparatus for draining water received from the side pan, the side pan having at least one support for supporting the side pan, the support sized so that in use the pan member is tilted so that water runs from the pan member to the adjacent lateral pan, the coil on a central pan having four spaced-apart sides and the drain pan system having the lateral pan sized and configured for use on either of two spaced apart sides of the central pan so that the coil is tiltable ninety degrees to the left or to the right and the side pan is disposable beneath the coil whichever way the coil is tilted; such a drain pan system including the air conditioning coil; and such a drain pan system including a housing in which the air conditioning coil is mounted, a blower for moving air through the housing, and at least two openings in the housing for circulating air therethrough.

It is, therefore, an object of at least certain preferred embodiments of the present invention to provide new, useful, unique, efficient and nonobvious drain pan apparatus for air conditioning systems (e.g. cooling or heating) and systems with such pan apparatus;

A further object of the present invention is the provision of new, useful, unique, and nonobvious apparatuses and methods for efficiently moving conditioned air to the outside of an apparatus;

An additional object of the present invention is the provision of such apparatuses which can accommodate a variety of air conditioning systems or furnaces;

A further object of the present invention is the provision of drain pan with a central pan, a lateral pan and a side pan without a drain so that a coil can be oriented vertically or horizontally to either side;

Yet another object of the present invention is the provision of a system in which a V-coil already installed in a housing may be positioned vertically or horizontally to either side without having to remove the coil from the housing;

An additional object of the present invention is the provision of such a drain pan with a lateral pan for facilitating sealing connection of a side pan to a central pan and a system with such a pan;

Another object of the present invention is the provision of such a drain pan and system useful in already existing housings and spaces; and An additional object of the present invention is the provision of a drain pan with an opening therethrough so that air may flow through the opening to a coil mounted on or above the pan; thus, permitting a coil on such a pan to be used in either a vertical flow or a horizontal flow system; and a pan-coil combination using such a pan.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one of skill in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this parent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

DESCRIPTION OF EMBODIMENTS PREFERRED AT THE TIME OF FILING FOR THIS PATENT

Figure 1A:
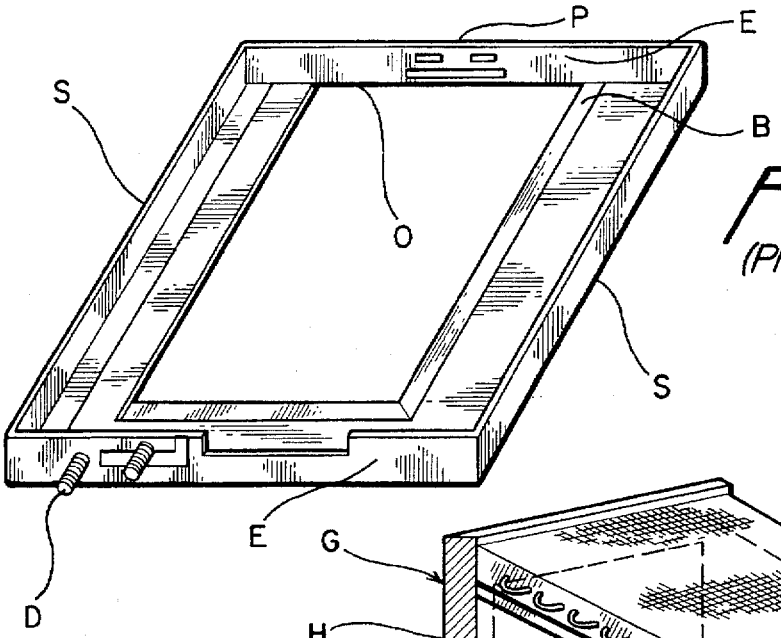
FIG. 1A (PRIOR ART)
FIG. 1A is a perspective view of a prior art air conditioning drain pan.
Figure 1B:
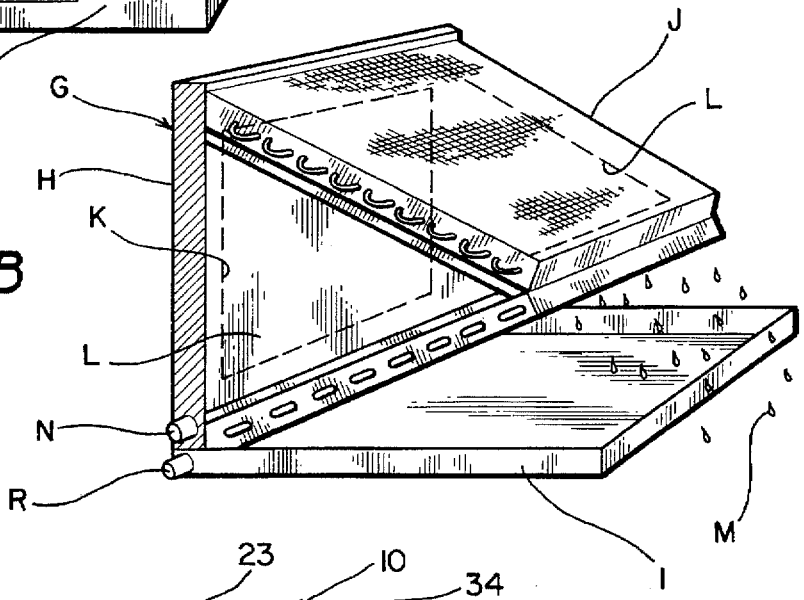
FIG. 1B (PRIOR ART)
FIG. 1B is a side perspective view of a prior art pan-coil combination.

Referring now to FIG. 1A, a typical prior art drain pan P has a bottom wall B, a bottom opening O, spaced-apart ends E, spaced-apart sides S interconnected between the ends E and a drain fitting D. FIG. 1B shows a prior art two-pan coil combination G with a first pan H, a second pan I and a coil J. In the orientation shown the combination G has the coil J tilted sideways and the pan I is disposed for receiving water dripping from the coil J. Air flows to the coil J through an opening K in the pan H. In a vertical orientation of the coil J, the pan H is disposed to receive water dripping from the coil J. Both ends of the coil J are blocked off by closure plates L. Pan H has its own drain nipple N and pan I has its own drain nipple R. In order to use the pan I on the other side of the pan H (the top side in FIG. 1B), e.g. if it is desired to turn the coil J 180° the other way on its other side, another drain would need to be provided on the pan I on a side opposite the side on which the drain nipple R is located.

As shown in FIGS. 2A–2D, a system 10 according to the present invention includes a central pan 20, and lateral pans 30 and 40 secured to the central pan 20. Only one lateral pan is necessary if it is removably secured to the central pan to provide either-way-horizontal disposition of the coil.

As shown in FIGS. 2A–2D, the central pan 20 has a bottom 21 with an opening 22 therethrough suitable for airflow to or from a coil on the pan. Opposed pan ends 23 and 24 are spaced apart and interconnected by sides 25 and 26. Water drains from the pan 20 through a drain fitting 27 or 28. Only one such drain fitting may be used in certain embodiments.

Figure 2A:
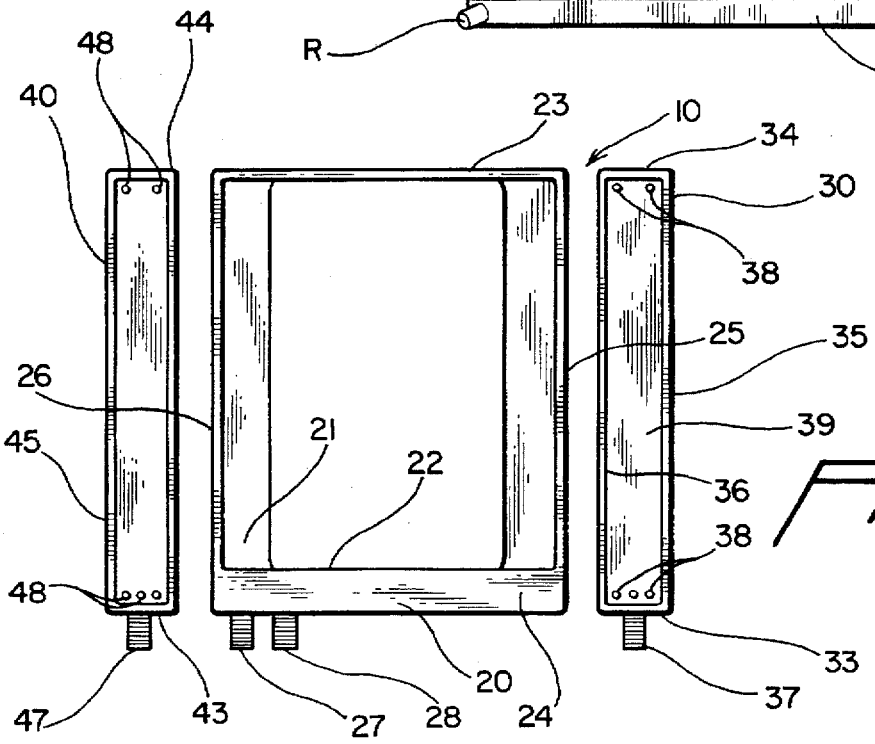
FIG. 2A is a top view of a drain pan system according to the present invention.
Figure 2B:
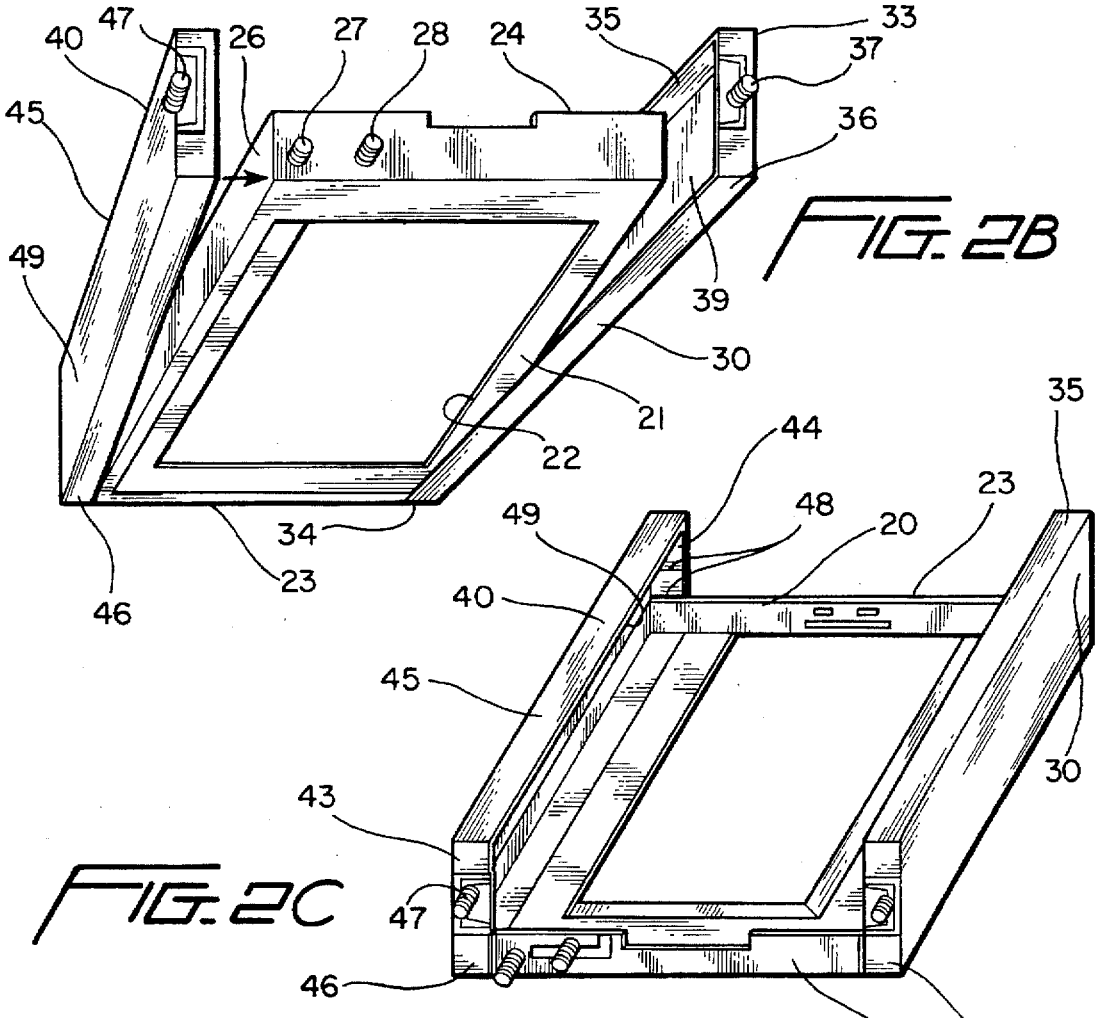
FIG. 2B is a bottom view of the system of FIG. 2A.

FIG. 2A shows lateral pans 30 and 40, one on each side of the central pan 20. It is within the scope of this invention to use only one lateral pan and for it to usable on either side of the central pan. The lateral pan 30 has two spaced-apart ends 33 and 34 interconnected by sides 35 and 36 with a bottom 39. The lateral pan 30 may be sealingly held on the side 25 of the central pan 20 by a friction fit. Also a positioning holding lip, ridge or rib 38 may be used to position the lateral pan on the central pan 20. Alternatively a stud or bottom, or series thereof, protruding inwardly from the pan ends may be used. Water drains from the lateral pan 30 through a drain fitting 37.

The lateral pan 40 has two spaced-apart ends 43 and 44 interconnected by sides 45 and 46 with a bottom 49. The lateral pan 40 may be sealingly held on the side 45 of the central pan 40 by a friction fit. Also a holding lip, ridge or rib 48 my be used to hold the lateral pan on the central pan 20. Alternatively a stud or bottom, or series thereof, protruding inwardly from the pan ends may be used.

By providing two ribs 38 at each end of the lateral pan, one lateral pan may be used on either side of the central pan; i.e., a kit including only one lateral pan and one side pan is all that is needed to go to a location with a coil already in place vertically upright in a housing and turn the housing with the coil horizontally either one way (e.g. to the left 90°) or the other way (e.g. to the right 90°) with the lateral pan and side pan in place on the appropriate side of the coil to catch moisture flowing therefrom. The lateral pan and side pan may be installed before or after the housing is turned.

Figure 2C:
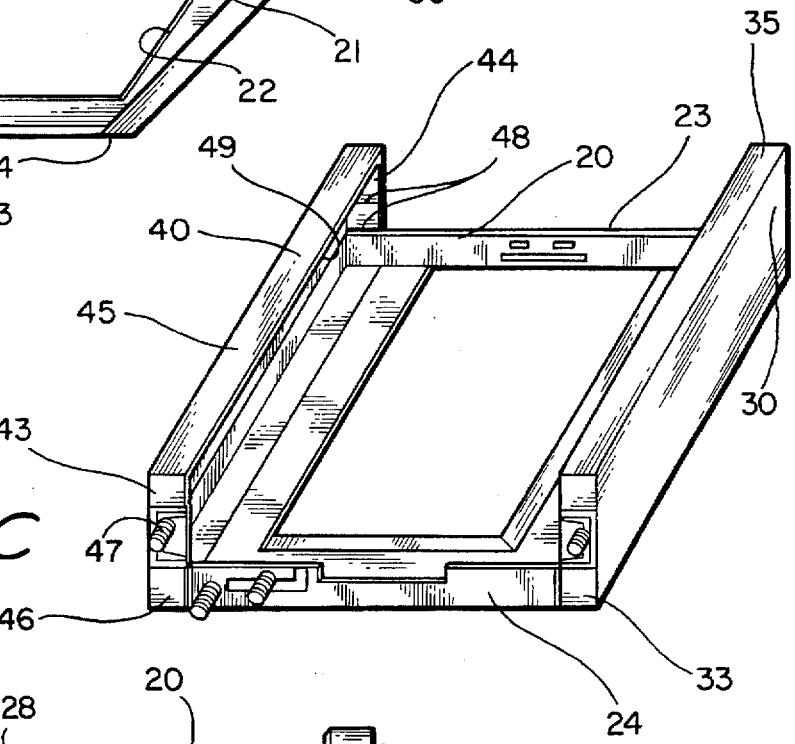
FIG. 2C is a top perspective view of the system of FIG. 2A.
Figure 2D:
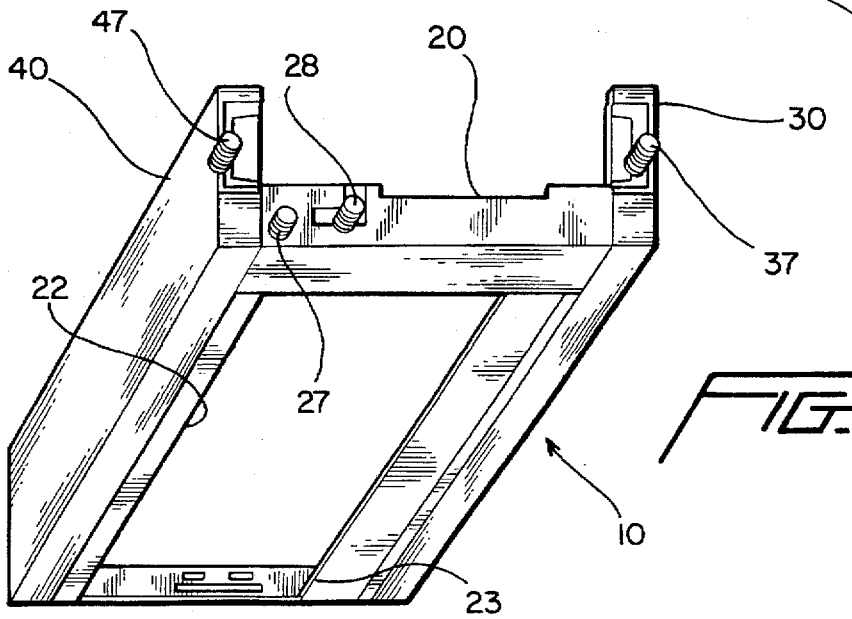
FIG. 2D is a bottom perspective view of the system of FIG. 2A.

FIG. 2C shows the lateral pan 40 in place on the central pan 20. The lateral pan 30 is in the process of being placed on a side of the central pan 20. As shown in FIG. 2D both lateral pans are in place on the central pan 20. The lateral pans may be welded or soldered to the central pan or they may be easily removed therefrom if only a friction fit is used. The lateral pans may be any height (as viewed e.g. in FIG. 2B). Two sets of ribs 48 render the lateral pan installable on either side of the central pan. 0f course the lateral pan(s) may be used without such ribs.

Figure 3:
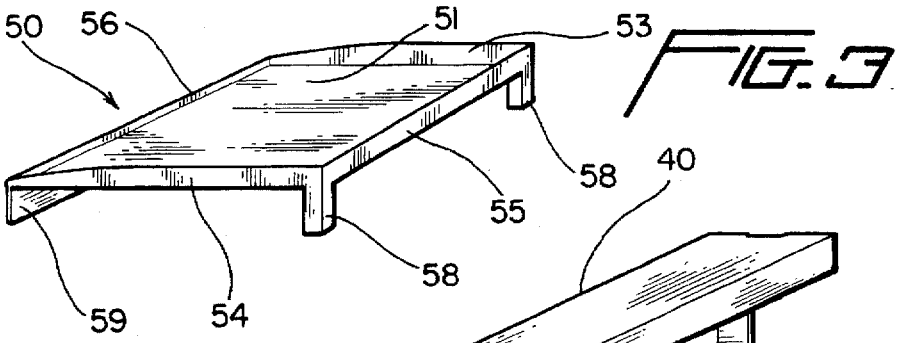
FIG. 3 is a perspective view of a side pan according to the present invention.
Figure 4:
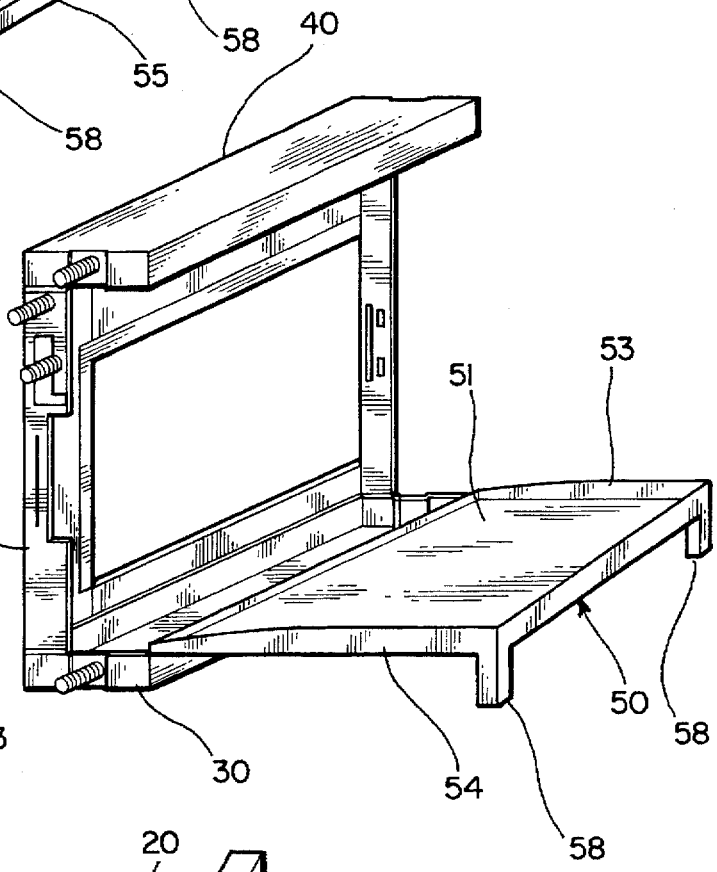
FIG. 4 is a top perspective view of a drain pan system according to the present invention.
Figure 5:
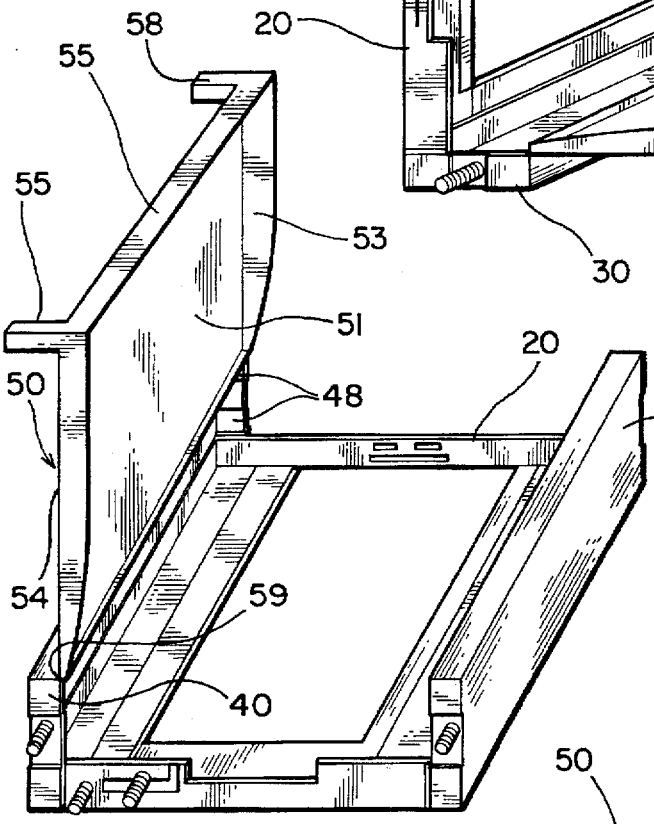
FIG. 5 is a top perspective view of a drain pan system according to the present invention.

FIG. 3 shows a side pan 50 according to the present invention with spaced-apart ends 53 and 54 interconnected by a side 55 with a bottom 51 and with two legs 58, one extending from each of two spaced-apart corners. A lip 59 extends down from an end 56 of the pan 50. The lip 59 is sized, shaped, and configured to be sealingly received in and held in one of the lateral pans between two ends of the lateral pan. As shown in FIG. 4 the side pan 50 has been installed on the lateral pan 30. As shown in FIG. 5, the side pan 50 has been turned around and installed on the lateral pan 40. If desired, the lateral pan 30 may be used instead of the lateral pan 40. It is also within the scope of this invention to install the pan 50 directly to the central pan 20 without the use of lateral pans if a drain or drain nipple is added to the side pan. In one such embodiment, the legs or support (see FIG. 6) for the side pan are sized so that the moisture flows to a desired end of the pan and a drain or nipple is used at the end either on the end or on the side at the end.

Figure 6:
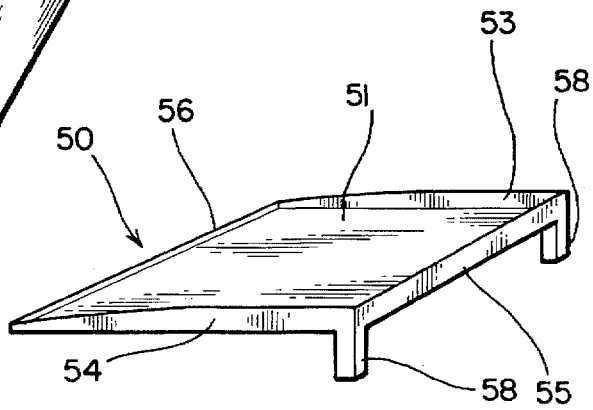
FIG. 6 is a perspective view of a pan according to the present invention.

FIG. 6 shows a side pan 50 with an open end 56 and no depending lip. Such a pan may be sealingly attached or secured to a central pan or a lateral pane.g. with epoxy or with a plastic connector with recesses, one for an end of the lateral pan and one for the end of the side pan.

Figure 7:
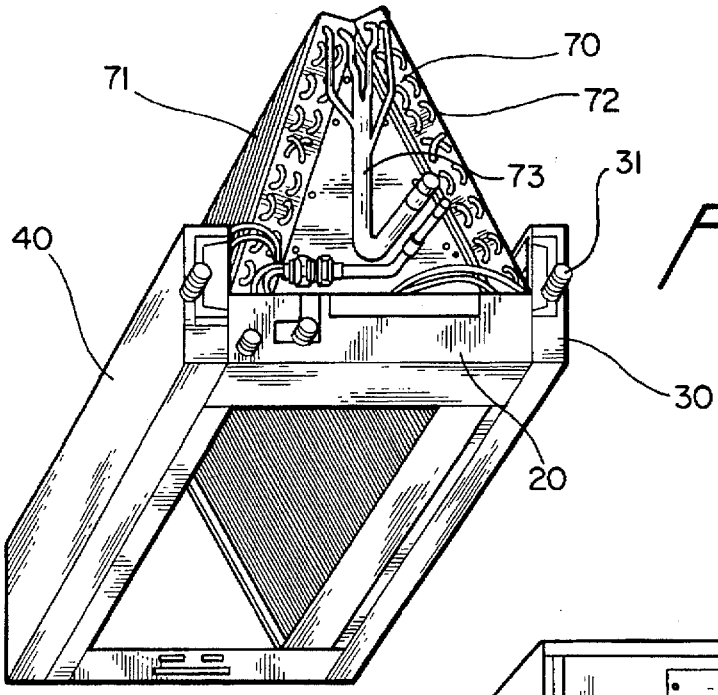
FIG. 7 is a bottom perspective view of a drain pan system with a coil according to the present invention.

FIG. 7 shows a coil 70 on a central pan 20 with lateral pans 30 and 40 on the central pan 20. The coil is generally V-shaped as viewed from the end shown in FIG. 6 with the V pointing upwardly. The coil 70 is a conventional, commercially available coil and has two interconnected sub-coils 71, 72 and flow apparatus 73 for heat transfer fluid flowing through the coil.

Figure 8:
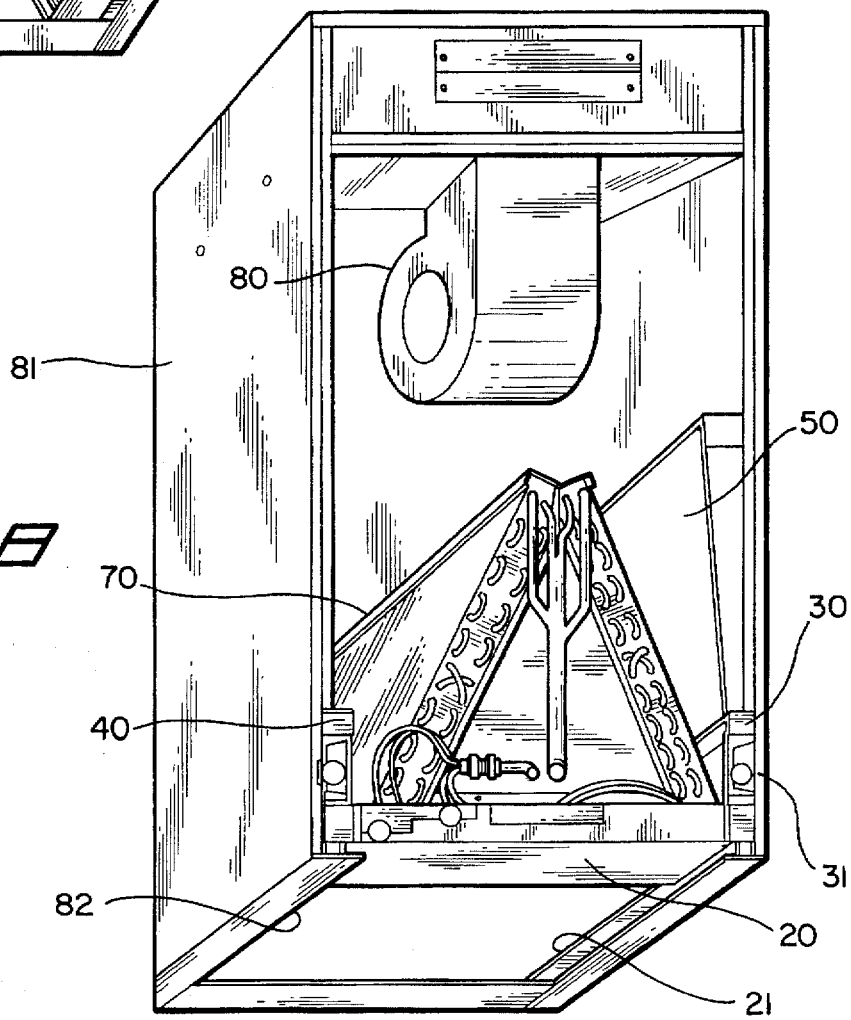
FIG. 8 is a perspective view of a system according to the present invention with a housing coil, and pan according to the present invention.

As shown in FIG. 8 the coil-70-pan-system-20-30-40-50 is in place in a typical housing 81 of an air conditioning system with a blower 80 which sucks air in through the opening 21, through the coil 70, and blows it out through a top opening (not shown) in the housing 81. With the side pan 50 in place, the housing 81 and its contents may be turned ninety degrees (to the right in FIG. 8) to assume a horizontal position and water (which flows down into the central pan 20 in the vertical orientation) flows down into the side pan 50 in this horizontal orientation. The water then flows to the lateral pan 30 and out through a drain nipple 31. As desired another pan 50 may be used connected to the lateral pan 40 or the pan 50 may be moved to the other side and installed on the pan 40 if there is a need to turn the housing ninety-degrees in the other direction.

It is preferred that the combined widths of a lateral pan and side pan in a system according to this invention exceed the height of a coil they are used with sufficiently to catch moisture blowing off the top end of the coil (which may be a side end in the horizontal position).

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. §102 and satisfies the conditions for patentability in §102. The invention claimed herein is not obvious in accordance with 35 U.S.C. §103 and satisfies the conditions for patentability in §103. This specification and the claims that follow are in accordance with all of the requirements of 35 U.S.C. §112.

What is claimed is:

1. A drain pan system for receiving water condensed on and flowing from an air conditioning coil, the pan comprising a lateral pan, a side pan for receiving water from the coil, the side pan having a pan member with three raised sides and an open end and configured so that water is flowable out from the open end, the open end sealingly securable to and adjacent the lateral pan so that water flowable from the open end flows to the adjacent lateral pan, the lateral pan comprising a bottom pan member surrounded by four interconnected sides, pairs of sides spaced apart from each other by the bottom pan member, and the lateral pan securable to a side of the central pan so that the side of the central pan is received within the lateral pan with a sealing friction fit, the side pan having a lip extending from the open end, the lip receivable in the adjacent lateral pan to facilitate positioning of the side pan with respect to the adjacent lateral pan and securement of the side pan to the adjacent lateral pan, and the side pan's open end sealingly connected to the adjacent lateral pan, the lateral pan having drain apparatus for draining water received from the side pan.

2. The drain pan system of claim 1 wherein the coil has a height, the side pan has a width, the lateral pan has a width, and the combined widths of the lateral pan and the pan member exceed the height of the coil sufficiently to catch moisture blowing from the coil.

3. The drain pan of system of claim 1 further comprising the side pan having at least one support for supporting the side pan, the support sized so that in use the pan member is tilted so that water runs from the pan member to the adjacent lateral pan.

4. The drain pan system of claim 1 further comprising holding apparatus on the lateral pan for facilitating receipt within the lateral pan of a side of the central pan and correct positioning of the lateral pan on the central pan, and for holding the lateral pan on the central pan.

5. The drain pan system of claim 1 wherein the central pan has four spaced-apart sides and the drain pan system further comprising the lateral pan sized and configured for use on either of two spaced apart sides of the central pan so that the coil is tiltable ninety degrees to the left or to the right and the side pan is disposable beneath the coil whichever way the coil is tilted.

6. The drain pan system of claim 1 including the air conditioning coil.

7. The drain pan system of claim 6 including a housing in which the air conditioning coil is mounted, a blower for moving air through the housing, and at least two openings in the housing for circulating air therethrough.

8. A drain pan system for receiving water condensed on and flowing from an air conditioning coil, the air conditioning coil on the central pan, the drain pan comprising a lateral pan, a side pan for receiving water from the coil, the side pan having a pan member with three raised sides and an open end configured so that water is flowable out from the open end, the open end sealingly secured to and adjacent the lateral pan so that water flowable from the open end flows to the adjacent lateral pan, the side pan having a lip extending from the open end, the lip receivable in the adjacent lateral pan to facilitate positioning of the side pan with respect to the adjacent lateral pan and securement of the side pan to the adjacent lateral pan, the side pan's open end sealingly connected to the adjacent lateral pan, the lateral pan having drain apparatus for draining water received from the side pan, the side pan having at least one support for supporting the side pan, the support sized so that in use the side pan is tilted so that water runs from the side pan to the adjacent lateral pan, the central pan having four spaced-apart sides, and the lateral pan sized and configured for use on either of two spaced apart sides of the central pan so that the air conditioning coil tiltable ninety degrees to the left or to the right and the side pan is disposable beneath the coil whichever way the air conditioning coil is tilted.

9. The drain pan system of claim 8 including a housing in which the air conditioning coil is mounted, a blower for moving air through the housing, and at least two openings in the housing for circulating air therethrough.

* * * * *